United States Patent [19]

Sirchia

[11] Patent Number: 4,777,724

[45] Date of Patent: Oct. 18, 1988

[54] MANUAL CEILING PANEL RABBET CUTTER

[76] Inventor: Michael Sirchia, 317 Palmer St., Elizabeth, N.J. 07202

[21] Appl. No.: 933,563

[22] Filed: Nov. 21, 1986

[51] Int. Cl.[4] ..... B26B 29/00

[52] U.S. Cl. ..... 30/287; 30/480

[58] Field of Search ..... 30/279 R, 287, 299, 30/303, 480, 486, 495

[56] References Cited

U.S. PATENT DOCUMENTS

| | | | |
|---|---|---|---|
| 2,038,884 | 4/1936 | Chalmer | 30/287 |
| 3,766,649 | 10/1973 | Winbauer | 30/287 |
| 4,180,908 | 1/1980 | Beerman | 30/287 X |
| 4,495,697 | 1/1985 | Ruff | 30/287 X |

FOREIGN PATENT DOCUMENTS

| | | | |
|---|---|---|---|
| 120224 | 11/1947 | Sweden | 30/480 |

*Primary Examiner*—E. R. Kazenske
*Assistant Examiner*—Michael D. Folkerts
*Attorney, Agent, or Firm*—David, Littenberg, Krumholz & Mentlik Lerner

[57] ABSTRACT

A cutter tool is provided with a handle member coupled to two portions arranged substantially orthogonally with respect to one another for supporting razor blades used to cut a rabbet along a corner edge of a ceiling panel. The two portions are arranged to form an inside corner guide which communicates with the corner edge of the ceiling panel during the manual cutting of the rabbet. The razor blades extend inward, orthogonally to one another, to cut the material of the ceiling panel during the manual operation of the cutter tool. A pair of cover plates is installed on the two portions for securing the razor blades thereto.

3 Claims, 1 Drawing Sheet

MANUAL CEILING PANEL RABBET CUTTER

BACKGROUND OF THE INVENTION

A hand held tool for cutting a recess on the ends of ceiling panels when such a cut is required. The cutter quickly and easily makes a rabbet cut through the panel ensuring a straight and uniform recess thereby making installation of the panel a simple procedure.

SUMMARY OF THE INVENTION

The rabbet cutter is a hand held tool that eliminates the problem of making a laborious recess cut with a knife. It is composed of two perpendicular blades which perform the double cut in one operation. The blades are removable and double sided for quick changes. Due to the nature of its construction it has a built in guide to ensure a smooth straight cut which is a top priority when dealing with ceiling panels.

DESCRIPTION OF THE PREFERRED EMBODIMENT

Figure 1:
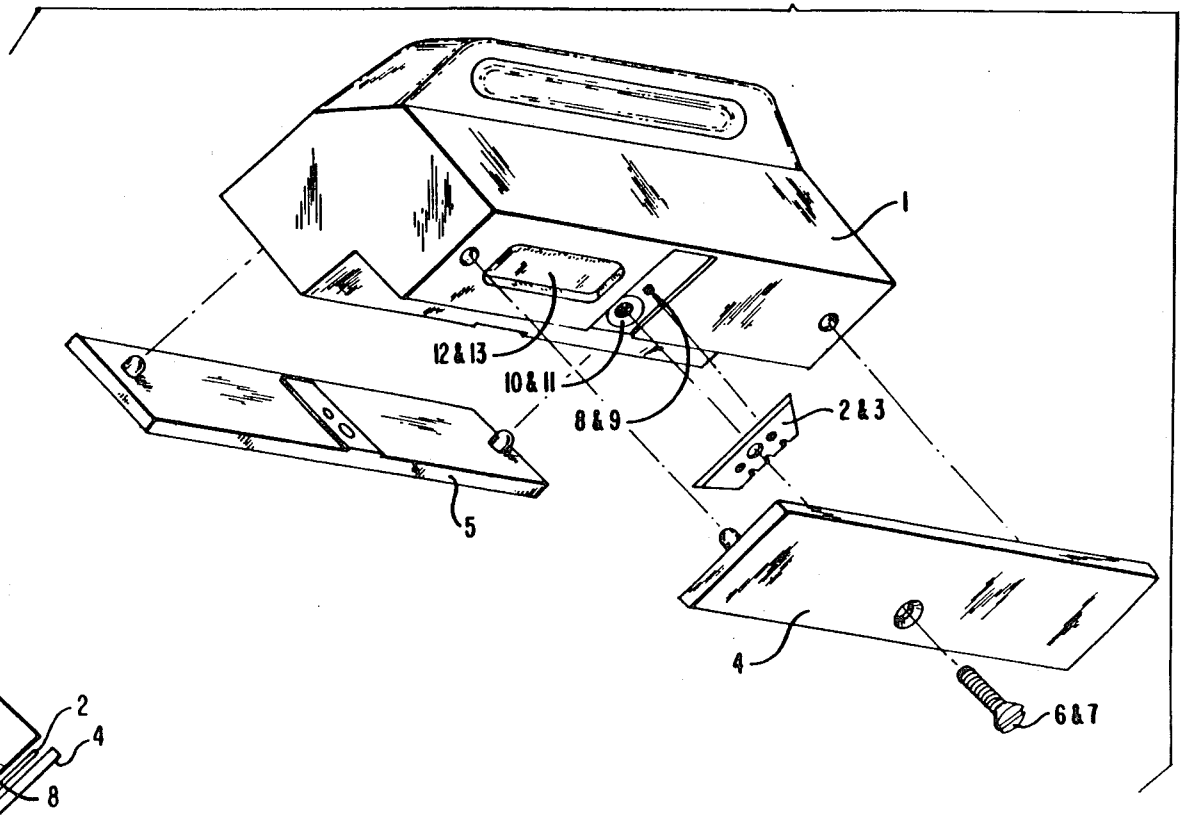
FIG. 1 is an exploded perspective view of the hand held main body of the cutter, a razor blade, and the cover plates.
Figure 2:
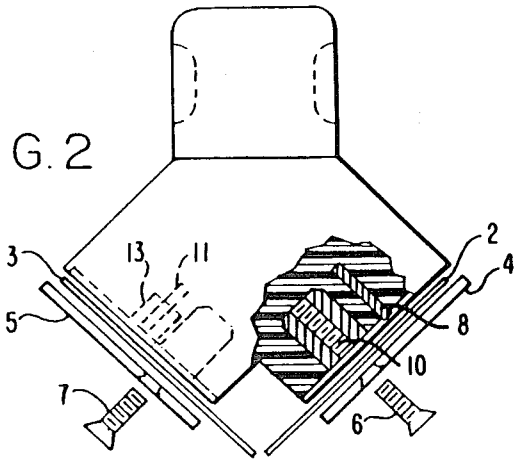
FIG. 2 is a partially phantom and partially cross-sectional end view of the rabbet cutter of the present invention shown in FIG. 1.

This rabbet cutter is composed of only thirteen components. The main component is the body (1) which is made of plastic. The body is the center to which all other parts are connected. The body is picked up by its integral handle and it contains recesses and dowels for snapping in the razor blades, blade covers, and screws. The main body also contains a recessed pocket areas (12) and (13) used for storage of blades for quick replacement. The identical razor blades (2) and (3) are not of the standard type, but are characterized by three circular holes. The outer circular holes are used for alignment purposes and the center hole is the one through which the connecting screws (6) and (7) pass. The metal dowels (8) and (9) that are inserted into the main body (1) are the alignment dowels for the blades. Either end hole of each blade will fit over the dowel. Once the blade is aligned and placed, the razor blade cover plates (4) and (5) are placed into position. The connecting screws are then tightened to hold the covers down. The screws are screwed into their respective receptacles. These receptacles (10) and (11) are really metal nuts firmly pressed into the main body (1). The screws could probably have been screwed directly into the plastic body, but the resulting torque would strip the plastic threads in time. The razor blades are double tipped so they can be turned around, thus reducing the frequency of inserting new blades. The identical razor blades cover plates (4) and (5) are also made of plastic. They serve the dual purpose of holding the blades firmly against the body and also act as a cutting guide.

I claim:

1. A manually operated cutter tool for cutting a rabbet along a corner edge of a ceiling panel, comprising:

a. unitary body means having first and second portions arranged orthogonally with respect to each other to form a corner guide for communicating with said corner edge of said ceiling panel, and a handle portion to facilitate the manual operation of the cutter tool, each of said portions having first and second surfaces in orthogonal relationship with respect to each other;

b. each of said first and second surfaces on said first and second portions including recessed means having a predetermined configuration for positioning a pair of razor blades parallel to said respective first and second surfaces whereby said pair of razor blades is thereby aligned in said recess means in a corresponding orthogonal relationship;

c. alignment dowels positioned within each of said recessed means for cooperative engagement with said pair of razor blades thereby providing the lateral alignment thereof; and d. fastening means to secure said pair of razor blades to said first and second surfaces.

2. The manually operated cutting tool of claim 1 including cover plates adapted to be secured against said first and second surfaces and first and second threadable engaging means for securing said cover plate against said first and second surfaces, said first and second threadable engaging means each being arranged to pass through said razor blade to further align said razor blade in said recess means while securing said cover plates to the respective first and second surfaces.

3. The manual cutting tool of claim 2, including razor blades positioned within said recess means, said razor blades being doubly tipped so that the same can be inverted to reduce the frequency of inserting new blades.

* * * * *